United States Patent [19]

Fehrenbacher

[11] 4,400,094

[45] Aug. 23, 1983

[54] ALARM-SETTING MECHANISM FOR TIMEPIECE WITH ESCAPEMENT PROTECTING AGAINST REVERSE ROTATION

[75] Inventor: Wolfgang Fehrenbacher, St. Georgen, Fed. Rep. of Germany

[73] Assignee: Kundo-Kieninger & Obergfell, St. Georgen, Fed. Rep. of Germany

[21] Appl. No.: 209,275

[22] Filed: Nov. 21, 1980

[30] Foreign Application Priority Data

Nov. 23, 1979 [DE] Fed. Rep. of Germany ..... 2947244

[51] Int. Cl.[3] ..... G04B 23/02; G04C 21/00

[52] U.S. Cl. ..... 368/266; 368/74

[58] Field of Search ..... 368/262–266, 368/269–271, 275, 74

[56] References Cited

U.S. PATENT DOCUMENTS

| | | | |
|---|---|---|---|
| 2,630,671 | 3/1953 | Ross | 368/266 |
| 2,678,528 | 5/1954 | Hamm | 368/266 |
| 2,966,027 | 12/1960 | Meyer | 368/266 |
| 3,264,818 | 8/1966 | Morrison et al. | 368/266 |
| 3,603,077 | 9/1971 | Ganter | 368/266 |

FOREIGN PATENT DOCUMENTS

| | | |
|---|---|---|
| 1692300 | 6/1954 | Fed. Rep. of Germany . |
| 1730087 | 9/1956 | Fed. Rep. of Germany . |
| 2030073 | 10/1970 | France . |
| 14898/66 | 2/1969 | Switzerland . |

*Primary Examiner*—Bernard Roskoski

*Attorney, Agent, or Firm*—Karl F. Ross

[57] ABSTRACT

A device for setting the time of actuation of a buzzer or other signal generator in an alarm clock comprises a flexible stem of a manually operable knob, rotatably journaled in two mounting plates, which carries a pinion normally engaging gear teeth of a disk freely rotatable about the hour shaft of the clockwork, the disk being under axial spring pressure urging it against an adjacent hour wheel which has one or more cutouts adapted to receive respective sawtooth-shaped cams on a confronting disk face when the wheel reaches the selected angular position. The user may turn the knob in either direction to advance or delay the selected time setting, except that any delay of 12 hours or more from the time of resetting is prevented by the interengagement of a steep cam flank with an edge of the associated cutout. If the user neverless turns the knob beyond that limit, the stem yields laterally and disengages its pinion from the disk teeth to obviate any damage to the mechanism.

13 Claims, 8 Drawing Figures

ALARM-SETTING MECHANISM FOR TIMEPIECE WITH ESCAPEMENT PROTECTING AGAINST REVERSE ROTATION

FIELD OF THE INVENTION

My present invention relates to a timepiece, specifically an alarm clock, having means for presetting the time when a buzzer or other signal generator is to be activated.

BACKGROUND OF THE INVENTION

The usual alarm clock has a control member provided with a manually rotatable presetting element, such as a knob, and juxtaposed with a coacting member of the clockwork making not more than two revolutions every 24 hours. The two members are provided with mating formations that are aligned with each other in one predetermined relative angular position thereof, thus once every 12 or possibly every 24 hours, in which one of these members is shiftable by suitable biasing means (e.g. a spring) from a normal into an off-normal position to operate activating means for setting off the signal generators. The activating means may comprise a mechanical trigger or a switch closing an electrical circuit; in either case, the mating formations on the two juxtaposed members are generally so designed as to interengage with a snap fit when the selected time position is reached by the clockwork and thereafter gradually to disengage themselves by camming action as the coacting member moves out of its predetermined relative angular position.

Because of the backstop effect created by the snap fit, the control member cannot be reverse-rotated once the mating formations of the two members are interengaged. If, then, a user intending to delay the sounding of the alarm attempts such reverse rotation, damage to the mechanism could result. It has therefore been the practice to provide the presetting element of an alarm clock with a one-way brake or a ratchet coupling preventing backward rotation in any position of the clockwork. The drawback of such an arrangement is that a user desiring to postpone the preset alarm-release time by, say, a fraction of an hour must turn the control knob through a number of revolutions corresponding to an advancement of that time by more than 11 hours (or more than 23 hours in the case of a 24-hour clock).

This drawback also exists where, e.g. as described in German utility model No. 1,692,300, the control member is linked with its presetting element by a unidirectional coupling including a gear which transmits only forward rotation but swings out of mesh upon being rotated in reverse.

OBJECT OF THE INVENTION

The object of my present invention, therefore, is to provide an improved time-setting device for such a timepiece which allows at least limited two-day displacement of a presettable control member while avoiding any risk of damage to the clockwork or other mechanical parts when the user attempts to rotate the backstopped control member in reverse.

SUMMARY OF THE INVENTION

I realize this object, in accordance with my present invention, by interconnecting the control member and its presetting element through a yieldable bidirectional coupling allowing rotation of the presetting element in either direction even upon interengagement of the mating formations of the control member and the coacting clockwork member.

In accordance with a more particular feature of my invention, the presetting element is a knob fixedly secured to a flexible stem terminating in a pinion at its free end, this pinion normally meshing with a set of gear teeth on the control member but being cammable out of engagement therewith upon a rotary backstopping of the control member.

Advantageously, the stem is tubular and traverses a preferably noncircular opening of a mounting plate with frictional fit so as to maintain the pinion and therefore the control member in a selected angular position.

BRIEF DESCRIPTION OF THE DRAWING

The above and other features of my present invention will now be described in detail with reference to the accompanying drawing in which.

SPECIFIC DESCRIPTION

Figure 2:
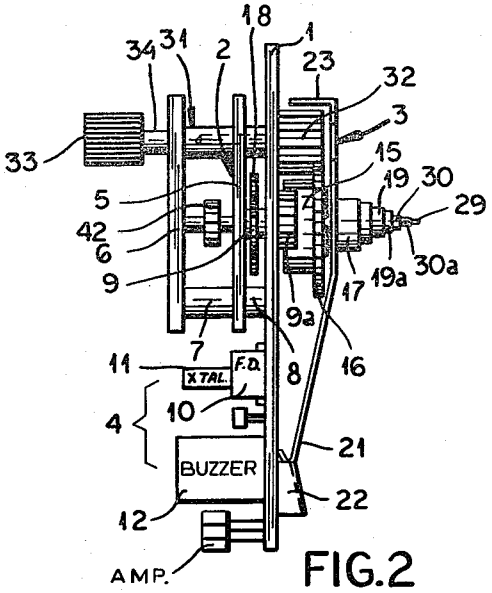
FIG. 2 is a side view of the assembly of FIG. 1 as seen from the left.
Figure 1:
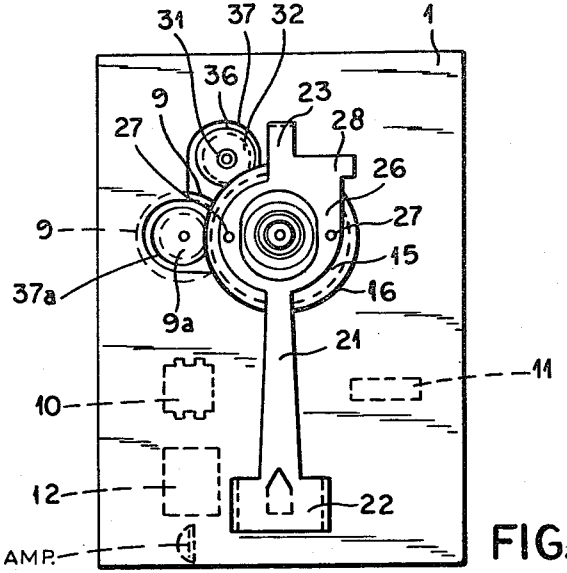
FIG. 1 is a front view of a timepiece (with housing, clockface and hands omitted) provided with a time-setting device according to my invention.
Figure 3:
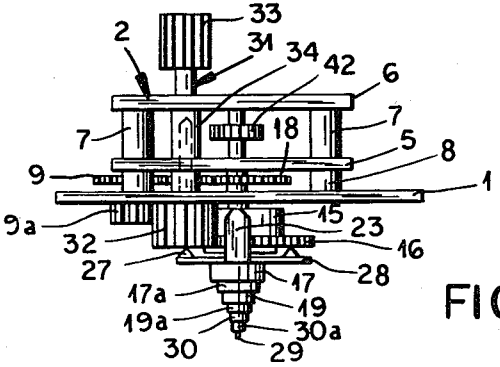
FIG. 3 is a top view of that assembly.
Figure 4:
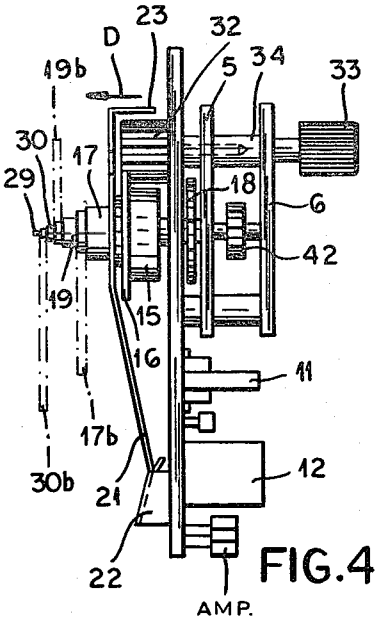
FIG. 4 is a side view as seen from the right of FIG. 1.

In FIGS. 1–4 I have shown a conventional clockwork 2, driven for example by a nonillustrated stepping motor, which is supported on a baseplate 1 and includes the usual gear assembly for driving a tubular hour shaft 19, a tubular minute shaft 30 coaxial therewith, and a seconds shaft 29 penetrating the latter. Shafts 19 and 30 have reduced ends **19*a* and 30*a* respectively carrying hour and minute hands 19*b*, 30*b* illustrated in phantom lines in FIG. 4; a seconds hand on shaft 29 has not been shown. Hour shaft 19 is rigid with an hour wheel 25 which has been shown only in FIG. 8 since it is received in a cutout of baseplate 1; its gear teeth are in mesh with those of a pinion 9*a* which is lodged in a cutout 37*a* of plate 1 and is rigid with another gear 9 behind that plate engaging a larger wheel 18 idling on shaft 30. The latter wheel is driven, via a nonillustrated further pair of step-down gears, by a minute wheel 42 fixed to shaft 30 which in turn is coupled by other gears with the motor-driven shaft 29**.

Baseplate 1 is connected by nonillustrated bolts, passing through spacers 8, with a mounting plate 5 which in turn is fastened by posts 7 to another such plate 6, the two mounting plates supporting an alarm mechanism generally designated 3. A presetting element 31, forming part of this mechanism, includes a manually rotatable knob 33 on a stem 34 which traverses plates 1, 5 and 6 and terminates in a pinion 32 meshing with a set of gear teeth 16 on a disk 15 coaxial with hour wheel 25 and shafts 19, 29 and 30. Disk 25 is freely rotatable and slidable on shaft 19 and has a hub 17 with a reduced end 17*a* carrying an alarm hand 17*b* as also indicated in phantom lines in FIG. 4.

A leaf spring 21 has one end fastened to a boss 22 at the front surface of plate 1 and extends generally radially across the disk 15, its free end forming a ring 26 around the disk axis with bumps 27 bearing upon the front face of the disk to urge same rearwardly toward the hour wheel 25 confronted thereby. This free end of spring 21 has a bent-over lug 23 which limits the rearward swing of the spring by abutting the plate 1 upon a leftward shift of disk 15 as viewed in FIG. 2.

Figure 8:
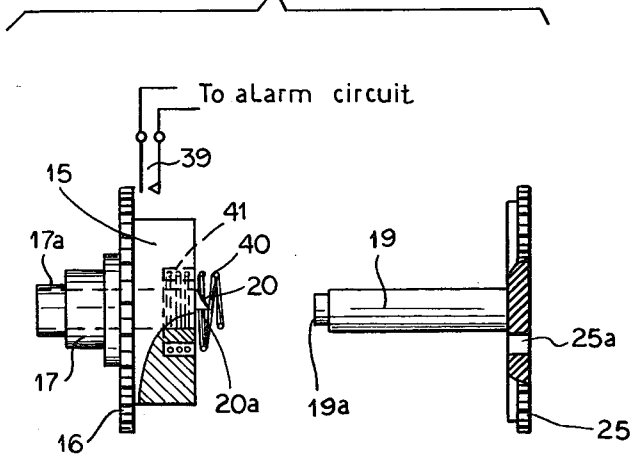
FIG. 8 is a side-elevational view of a control disk and a coacting hour wheel (in a disassembled state) forming part of the timepiece of FIGS. 1–4.

As illustrated in FIG. 8, disk 15 is provided on its rear face with at least one sawtooth-shaped camming formation 20 which, in a predetermined relative position of the disk and the hour wheel 25, is aligned with a cutout 25*a* of this wheel so as to snap into this cutout, under the axial pressure of spring 21 (FIGS. 1–4), when the wheel 25 reaches that position. A steep flank 20*a* of tooth 20 then prevents any reverse rotation of disk 15 while its sloping ramp surface allows the tooth to be dislodged from cutout 25*a* as the hour wheel 25 continues its normal movement. When disk 15 approaches the wheel 25 upon the interengagement of formations 20 and 25*a*, it closes a switch 39 to activate an alarm circuit 4 (FIG. 2) whose components include a crystal-controlled oscillator 11, a frequency divider 10 and a buzzer 12 mounted on the rear surface of baseplate 1. The alarm circuit can be disabled by the user through operation of a nonillustrated detent engaging a tab 28 of spring 21 so as to lift that spring off the disk 15 as indicated by an arrow D in FIG. 4; upon such disengagement, members 15 and 25 are held separated by a coil spring 40 which is weaker than spring 21 and is received in an annular groove 41 on the rear face of disk 15.

If several teeth 20 and cutouts 25*a* are provided, they should be unevenly distributed over the surfaces of disk 15 and wheel 25 so as to interengage only in one relative angular position thereof.

Figure 5:
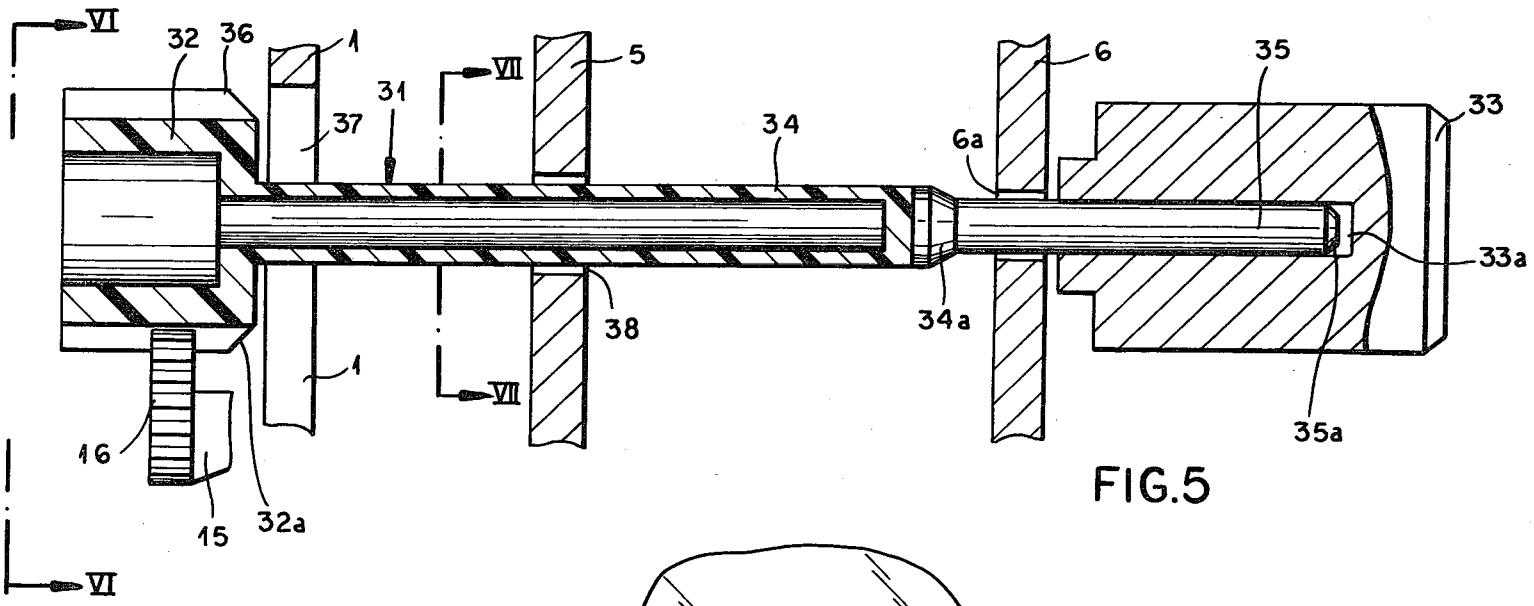
FIG. 5 is an enlarged sectional view of a bidirectional coupling included in the device of FIGS. 1–4.

As more clearly illustrated in FIG. 5, stem 34 is tubular and molded integral with the associated pinion 32 of a resilient plastic material such as polyethylene, for example. Stem 34 has a solid extension 35 of smaller diameter received with a tight fit in knob 33, their beveled shoulders 34*a* and 35*a* facilitating insertion into openings 38 and 6*a* of mounting plates 5 and 6 as well as into an axial bore 33*a* of knob 33; pinion 32 has teeth 36 also shown beveled at 32*a*. Baseplate 1 has a cutout 37 which merges into the cutout 37*a* accommodating the pinion 9*a* and which is of larger radius than pinion 32 to enable the removal of presetting element 31 together with its mounting plates 5 and 6 if this should be desired.

Figure 7:
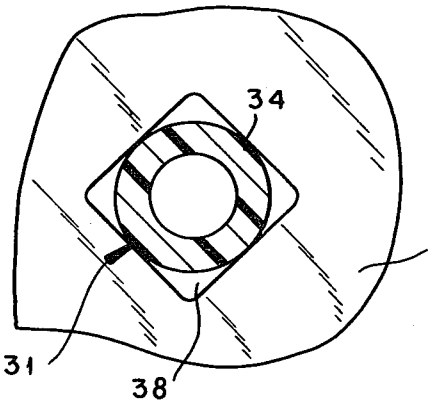
FIG. 7 is a fragmentary cross-sectional view taken on the line VII—VII of FIG. 5.

While the opening 6*a* of plate 6 is circular to serve as a journal bearing for stem 34, opening 38 has a polygonal shape with an inscribed circle of a diameter slightly smaller than that of tube 34 in its undeformed state. This causes a certain compression of tube 34 in opening 38 and the exertion of a braking effect on element 31 so as to prevent spontaneous departure of knob 33 from its chosen setting. More specifically, opening 38 is shown in FIG. 7 to have a square outline with a diagonal in the common axial plane of pinion 32 and disk 15 whereby that pinion can be readily deflected radially outward, as indicated by an arrow A in FIG. 6, when the user turns the knob 33 clockwise (arrow B) so as to tend to rotate the disk 15 in its reverse, counterclockwise sense (arrow C) but when such reverse rotation is prevented by the tooth flank 20*a* engaging in cutout 25*a*. The outward deflection of pinion 32, facilitated by the cutout 37 and the substantial distance of the pinion from mounting plate 5, disengages its teeth 35 from the disk teeth 16 so that continued clockwise rotation of knob 33 and pinion 32 will have no adverse effect upon the disk 15, the hour wheel 25 and their mating formations 20, 25*a*.

Figure 6:
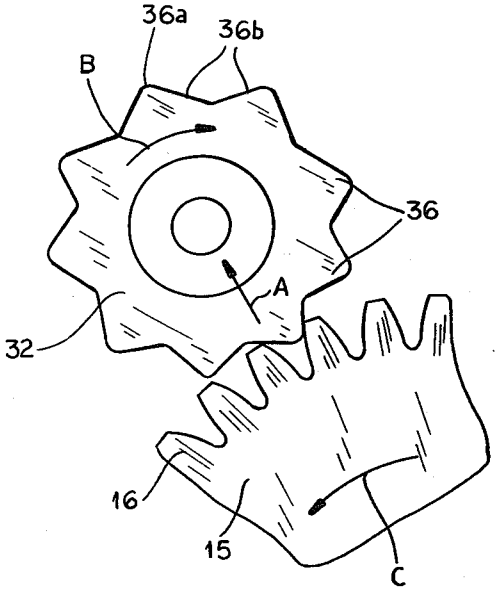
FIG. 6 is a fragmentary detail view as seen in the direction IV—IV in FIG. 5.

FIG. 6 shows an advantageous profile for the teeth 36 of pinion 32, designed to entrain the disk 15 in either direction when that disk is free to rotate but to cam the pinion outward when the disk is backstopped. Teeth 36 are seen to have rounded crests 36*a*; the flanks 36*b* of adjacent teeth include an obtuse angle with each other. The gear teeth 16 of disk 15, which can be of conventional involuted or epicycloidal shape, have a smaller pitch than teeth 36 and are about twice as high.

In operation, a user having preset the alarm for operation at, say, 0600 hours (6 a.m.) may decide the night before, e.g. at 2000 hours (8 p.m.), to delay the awakening by one hour. Since at that instant the tooth 20 is disaligned from the cutout 25*a*, disk 15 may be rotated in either direction so that the user will be able to turn it counterclockwise (arrow C in FIG. 6) through the desired angle of 30° without setting off the alarm or encountering the resistance of the hour wheel. In fact, the delay settable at this time may be almost two hours and may be even further extended later on. When the alarm is deactivated by a separation of spring 21 from disk 15, as described above, adjustment of the alarm hand 17*b* in either direction will be completely uninhibited. Naturally, the alarm circuit partly shown in FIG. 8 may also include a switch for electrically disabling the buzzer 12 without the need for moving or immobilizing the spring 21 by means of its tab 28.

In principle, the male and female formations 20 and 25*a* on disk 15 and wheel 25 could be interchanged, with the hour wheel carrying one or more camming teeth and with the disk having a corresponding number of mating cutouts. The arrangement shown in FIG. 8, however, is advantageous since cutouts 25*a* may be provided in hour wheels of clocks with or without alarm mechanisms 3 whereas teeth 20 on the hour wheels may be undesirable in timepieces lacking such a mechanism.

I claim:

1. In a timepiece provided with a clockwork, alarm means including a normally inactive signal generator, a control member coupled with a manually rotatable presetting element and juxtaposed with a coacting member of said clockwork making not more than two revolutions every 24 hours, said members being provided with mating formations alignable in one predetermined relative angular position thereof, biasing means for shifting one of said members from a normal position into an off-normal position upon alignment of said formations, and activating means operable by said one of said members in said off-normal position thereof for setting off said signal generator, interengagement of said formations preventing entrainment of said control member by said presetting element in one direction of rotation, the imporvement wherein said presetting element is a knob fixedly secured to a flexible stem which is linked with said control member by a yieldable bidirectional coupling allowing rotation of said presetting element in either direction upon interengagement of said formations, said bidirectional coupling comprising a pinion on a free end of said stem and a set of gear teeth on said control member normally in mesh with said pinion, the latter being radially cammable out of engagement with said gear teeth by a flexing of said stem upon a rotary backstopping of said control member.

2. The improvement defined in claim 1 wherein said clockwork is provided with a housing including at least one mounting plate traversed with frictional fit by said stem.

3. The improvement defined in claim 2 wherein said stem is tubular and passes through a noncircular opening of said mounting plate.

4. The improvement defined in claim 3 wherein said opening is of polygonal outline with a diagonal in a common axial plane of said stem and said control member.

5. The improvement defined in claim 4 wherein said opening is a square.

6. The improvement defined in claim 1, 2, 3, 4 or 5 wherein said pinion has teeth with rounded crests, the flanks of adjacent teeth including an obtuse angle with each other.

7. The improvement defined in claim 3, 4, or 6 wherein said stem and said pinion are integrally formed from elastomeric material.

8. The improvement defined in claim 7 wherein said stem has a reduced solid extension firmly seated in a central bore of said knob.

9. The combination defined in claim 1 wherein said coacting member is a gear wheel connected by a tubular shaft to an hour hand of the clockwork, said control member being a disk freely rotatable on said tubular shaft.

10. The improvement defined in claim 9 wherein said formations are at least one sawtooth-shaped cam on said disk and at least one cutout on said gear wheel.

11. The improvement defined in claim 9 or 10 wherein said tubular shaft is journaled in a baseplate, said biasing means comprising a leaf spring extending generally radially of said disk and having an end remote from said disk secured to said baseplate while axially bearing with an opposite end upon said disk.

12. The improvement defined in claim 11 wherein said opposite end forms a ring around said tubular shaft and is provided with an extension positioned to abut said baseplate upon a shift of said disk into said off-normal position.

13. The improvement defined in claim 12 wherein said opposite end is further provided with a tab enabling disengagement of said leaf spring from said disk.

* * * * *